US009347672B2

(12) United States Patent
Jungbauer et al.

(10) Patent No.: US 9,347,672 B2
(45) Date of Patent: May 24, 2016

(54) APPARATUS FOR A COOKTOP HAVING A CAMERA FOR RECOGNITION OF OPERATING GESTURES

(71) Applicant: E.G.O. Elektro-Geraetebau GmbH, Oberderdingen (DE)

(72) Inventors: Markus Jungbauer, Bruchsal-Obergrombach (DE); Martin Baier, Ettlingen (DE)

(73) Assignee: E.G.O. ELEKTRO-GERAETEBAU GMBH, Oberderdingen (DE)

( * ) Notice: Subject to any disclaimer, the term of this patent is extended or adjusted under 35 U.S.C. 154(b) by 441 days.

(21) Appl. No.: 13/785,651

(22) Filed: Mar. 5, 2013

(65) Prior Publication Data

US 2013/0228564 A1 Sep. 5, 2013

(30) Foreign Application Priority Data

Mar. 5, 2012 (DE) ..... 10 2012 203 460

(51) Int. Cl.

| | |
|---|---|
| ***H05B 3/68*** | (2006.01) |
| ***H05B 1/02*** | (2006.01) |
| ***F24C 7/08*** | (2006.01) |
| ***H05B 6/12*** | (2006.01) |

(52) U.S. Cl.

CPC *F24C 7/083* (2013.01); *H05B 3/68* (2013.01); *H05B 6/1209* (2013.01); *H05B 2213/07* (2013.01)

(58) Field of Classification Search

CPC ..... F24C 7/083; H05B 2213/07; H05B 3/68; H05B 6/1209

USPC ..... 219/443.1–468.2, 518

See application file for complete search history.

(56) References Cited

U.S. PATENT DOCUMENTS

| | | | | |
|---|---|---|---|---|
| 5,138,135 | A * | 8/1992 | Husslein et al. | 219/445.1 |
| 5,571,434 | A * | 11/1996 | Cavener et al. | 219/452.12 |
| 7,238,929 | B2 | 7/2007 | Baier | |
| 2002/0134817 | A1* | 9/2002 | Shepard | 228/105 |
| 2005/0061958 | A1 | 3/2005 | Baier | |
| 2005/0105759 | A1 | 5/2005 | Roberts et al. | |
| 2008/0017046 | A1 | 1/2008 | Huber et al. | |
| 2010/0114339 | A1 | 5/2010 | Kaiser et al. | |
| 2010/0182136 | A1 | 7/2010 | Pryor | |

FOREIGN PATENT DOCUMENTS

| | | | |
|---|---|---|---|
| CH | 700524 | A1 | 8/2010 |
| DE | 10345352 | A1 | 4/2005 |
| DE | 10361341 | A1 | 7/2005 |
| DE | 202009003894 | U1 | 7/2009 |
| DE | 102011075187 | B3 | 10/2012 |
| EP | 1517089 | A1 | 3/2005 |

(Continued)

OTHER PUBLICATIONS

German Patent and Trade Mark Office, Office Action for Application No. 102012203460.9, Nov. 8, 2012, 4 pages, Germany.

(Continued)

*Primary Examiner* — Sang Y Paik

(74) *Attorney, Agent, or Firm* — Alston & Bird LLP

(57) ABSTRACT

A cooktop includes a boundary element which borders the cooktop at least on one side, and a camera for recognition of operating gestures, wherein the camera is arranged in a recess of the boundary element.

9 Claims, 1 Drawing Sheet

(56) References Cited

FOREIGN PATENT DOCUMENTS

| | | | | |
|---|---|---|---|---|
| EP | 1669677 | | * | 6/2006 |
| EP | 1937032 | A1 | | 6/2008 |
| WO | WO 03/027942 | A1 | | 4/2003 |
| WO | WO 2005/106335 | A2 | | 11/2005 |

OTHER PUBLICATIONS

European Patent Office, Extended European Search Report for Application No. 13157395.8, Jun. 17, 2013, 7 pages, German Patent and Trade Mark Office, Germany.

* cited by examiner

APPARATUS FOR A COOKTOP HAVING A CAMERA FOR RECOGNITION OF OPERATING GESTURES

CROSS-REFERENCE TO RELATED APPLICATIONS

This application claims priority to German Application No. 10 2012 203 460.9, filed Mar. 5, 2012, the contents of which are hereby incorporated herein in its entirety by reference.

TECHNOLOGICAL FIELD

The invention relates to a cooktop having a camera for recognition of operating gestures.

BACKGROUND

In the not pre-published DE 10 2011 075 187, a camera for home appliance control by means of control gestures is described. The camera is arranged in a stove platform or cooktop platform frame underneath a glass-ceramics plate.

However, during operation, in stove platforms temperatures can occur which exceed an allowed operational temperature of the camera so that constructional measures are to be taken which prevent the allowed operational temperature from being surpassed.

BRIEF SUMMARY

The object underlying the invention is to provide a cooktop (also called hob) having a camera for recognition of operating gestures which allows a most simple and cost-efficient integration of the camera.

The invention achieves the object by means of a cooktop.

The cooktop comprises: a boundary or limiting element which borders or limits the cooktop in a cooktop plane at least on one side, and a conventional camera for recognition of operating gestures, wherein the camera is arranged in a recess, for example in the form of a hole, a cascaded hole having different diameters, or a blind hole, of the boundary element outside a cooking or cooktop platform. Since the camera is not arranged in the cooking platform per se or not under a glass-ceramics plate, it is not exposed to the temperatures occurring there. Furthermore, the boundary element can proficiently dissipate heat to the environment so that major temperature fluctuations can be prevented.

The boundary element can border the cooktop on such a side that is to be oriented towards a user. Generally, this is the front side of the cooktop.

The boundary element can be a conventional cooking or cooktop platform frame (also called stovetop frame). The cooktop platform frame can completely frame the cooktop.

As an alternative, the boundary element can be an operating bar which in particular is provided at a front side of the cooktop and on which operating elements can be provided to supplement the gesture control.

The boundary element can be made of metal. For example, the boundary element can be a circumferential stainless steel frame.

The cooktop can comprise an illuminant synchronized with the camera, in particular an infrared illuminant.

The cooktop can comprise a glass-ceramics plate on which conventional cooking areas or cooking zones are provided, wherein the illuminant is arranged underneath the glass-ceramics plate.

The camera can be a 2-dimensional (2D) camera or a 3-dimensional (3D) camera, for example a Time-Of-Flight (TOF) camera or a stereo camera.

BRIEF DESCRIPTION OF THE SEVERAL VIEWS OF THE DRAWINGS

The invention is subsequently described with reference to the drawings which represent embodiments of the invention. In this case, the figures schematically show in.

DETAILED DESCRIPTION

Figure 1:
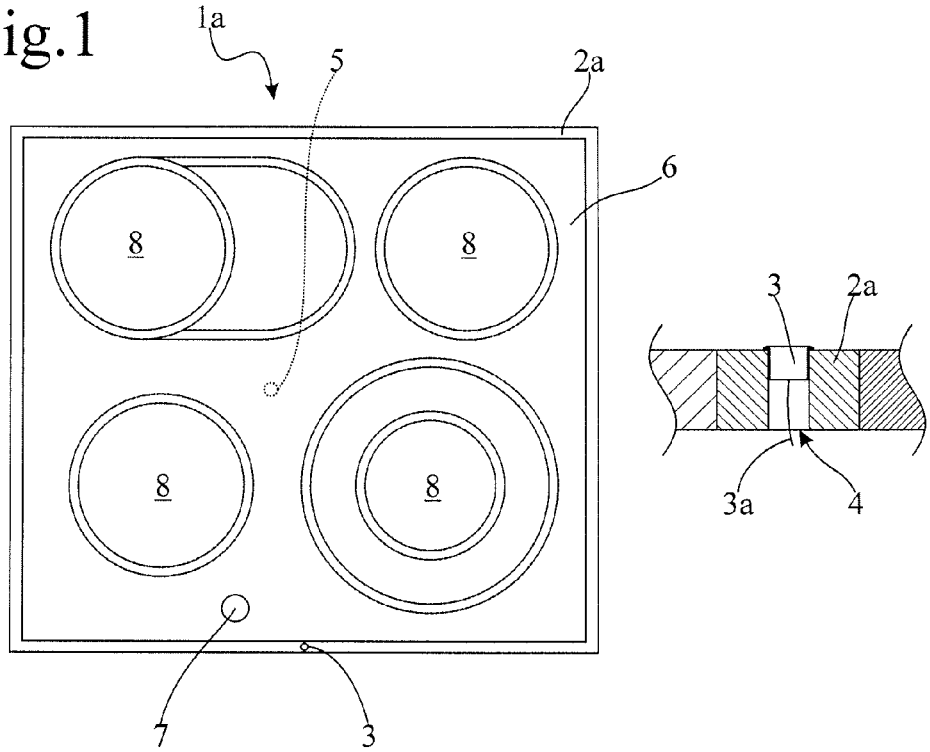
FIG. 1 a cooktop having a camera for recognition of operating gestures according to a first embodiment.

FIG. 1 schematically shows a cooktop 1*a* having a boundary element in the form of a circumferential cooking platform frame 2*a* made from stainless steel, which frames a glass-ceramics plate 6 including several cooking areas or cooking zones 8, and having a conventional 2D camera or 3D camera 3 for recognition of operating gestures. Optionally, a conventional, supplementing operating element 7 can be provided, for example in the form of a rotary knob, a capacitive key button for switching-on or switching-off, etc.

The camera 3 is arranged in a front-sided recess 4 of the cooking platform frame 2*a*, wherein connection leads 3*a* are directed downwards in the direction of an evaluation unit not shown. As illustrated, the recess can be realized in the form of a hole. As an alternative, holes vertically adjoining one another and having different diameters can be provided, for example, wherein a diameter of the upper hole corresponds to a diameter of the camera 3 and the lower hole has a minor diameter which is selected such that the connection leads 3*a* can be directed to the outside.

An infrared (IR) illuminant 5 is provided in a region under the glass-ceramics plate 6 which is relatively translucent for infrared light. The infrared illuminant 5 is synchronized with a shutter frequency of the camera 3.

Figure 2:
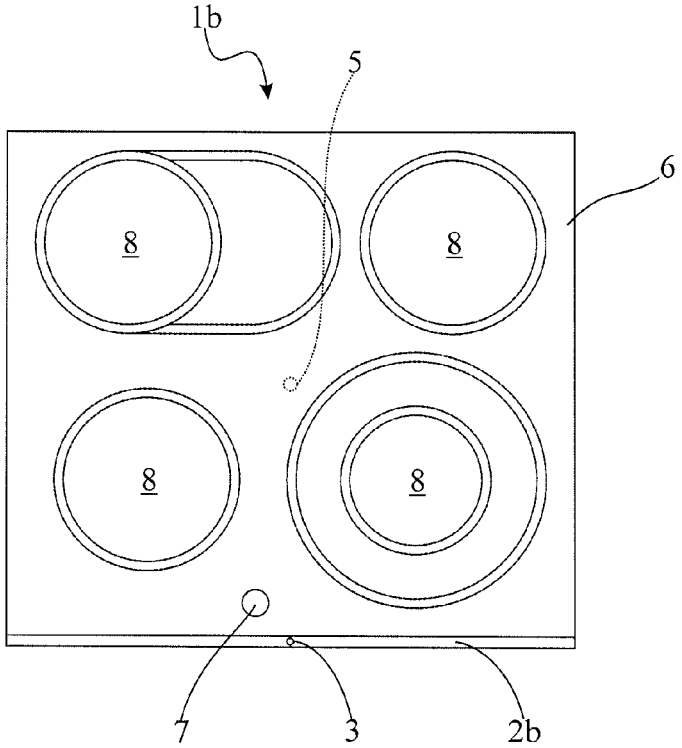
FIG. 2 a cooktop having a camera for recognition of operating gestures according to another embodiment.

FIG. 2 shows a cooktop 1*b* according to another embodiment. In this embodiment, instead of the circumferential cooking platform frame 2*a* shown in FIG. 1, a front-side operating bar 2*b* is provided in which the camera 3 is integrated.

According to the invention, the camera is located outside the cooking platform in a side part of the cooktop, for example in a metal frame of the cooktop. The metal frame or the operating bar at the front side can proficiently dissipate heat to the environment, so that major temperature fluctuations can be prevented.

Additional constructional measures can be taken to the effect that hot cookware cannot be placed onto the camera in this region.

That which is claimed:

1. A cooktop comprising:

a boundary element which borders the cooktop at least on one side;

a camera configured to recognize operating gestures, wherein the camera is arranged downward in a recess hole within the boundary element;

a glass-ceramics plate which is relatively translucent for infrared light; and an infrared illuminant, wherein the infrared illuminant is arranged underneath the glass-ceramics plate and is synchronized with the camera.

2. The cooktop according to claim 1, wherein:
the boundary element borders the cooktop on a side which is to be oriented towards a user.

3. The cooktop according to claim 1, wherein:
the boundary element is a cooktop platform frame.

4. The cooktop according to claim 3, wherein:
the cooktop platform frame completely frames the cooktop.

5. The cooktop according to claim 1, wherein:
the boundary element is an operating bar.

6. The cooktop according to claim 1, wherein:
the boundary element is made of metal.

7. The cooktop according to claim 1, wherein:
the camera is a 2-dimensional (2D) camera or a 3-dimensional (3D) camera.

8. The cooktop according to claim 1, wherein:
the infrared illuminant is synchronized with a shutter frequency of the camera.

9. The cooktop according to claim 1, wherein:
the camera comprises one or more connection leads directed downward in the recess.

* * * * *